United States Patent [19]

Jansz

[11] 4,226,287

[45] Oct. 7, 1980

[54] APPARATUS FOR PILE DRIVER CUSHION RECOIL

[75] Inventor: Joost W. Jansz, The Hague, Netherlands

[73] Assignee: Hollandsche Beton Groep N.V., Rijswijk, Netherlands

[21] Appl. No.: 922,538

[22] Filed: Jul. 7, 1978

[30] Foreign Application Priority Data

Jul. 15, 1977 [GB] United Kingdom ..... 29928/77

[51] Int. Cl.[3] ..... E02D 7/10; E02D 7/14

[52] U.S. Cl. ..... 173/126

[58] Field of Search ..... 175/19, 135; 173/118, 173/102, 103, 112, 114, 128, 135, 139, 131, 126, 127; 92/85 B

[56] References Cited

U.S. PATENT DOCUMENTS

| | | | |
|---|---|---|---|
| 3,417,828 | 12/1968 | Duyster et al. | 175/19 |
| 4,078,619 | 3/1978 | Sudnishnikov et al. | 175/19 |
| 4,102,408 | 7/1978 | Ludvigson | 173/131 X |
| 4,109,734 | 8/1978 | Montabert | 173/114 |
| 4,121,671 | 10/1978 | West | 173/103 X |

FOREIGN PATENT DOCUMENTS

| | | | |
|---|---|---|---|
| 271776 | 2/1911 | Fed. Rep. of Germany | 173/135 |
| 7711956 | 5/1978 | Netherlands | 173/139 |
| 250816 | 1/1970 | U.S.S.R. | 175/135 |

*Primary Examiner*—Werner H. Schroeder
*Assistant Examiner*—Andrew M. Falik
*Attorney, Agent, or Firm*—Brisebois & Kruger

[57] ABSTRACT

In an apparatus for driving a pile or similar object by the stroke of a hammer, the impact of a hammer stroke is transmitted to the pile or similar object through resilient means comprising a precompressed gas in at least two closed chambers, which may intercommunicate, arranged in series.

10 Claims, 9 Drawing Figures

APPARATUS FOR PILE DRIVER CUSHION RECOIL

Figure 1:
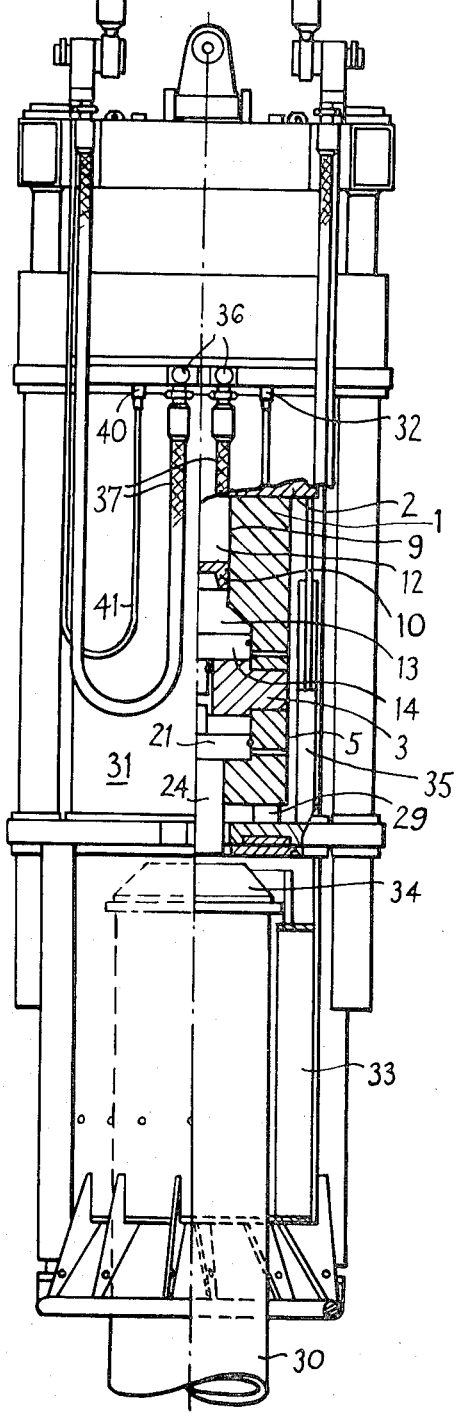

This invention relates to apparatus for driving piles and similar objects by the stroke of a hammer.

The specification of our U.S. Pat. No. 3,417,828 describes a pile driving apparatus which has resilient means in the path of the hammer for transmitting the impact of the hammer stroke to a pile, conventionally through a pile cap or anvil on the top of the pile. The resilient means comprises pre-compressed gas in a closed chamber and the stroke energy of the hammer is transmitted via the gas and a striker piston to the pile, the closed chamber confining the gas by a pressure sealing system. The sriker piston may project from the chamber. The gas is pre-compressed to such an extend that under the impact the minimum force exceeding the ground resistance is directly available. The impact force gradually increases due to the resilience of the gas to a maximum which avoids damage to the pile and also to the hammer unit.

Apparatus according to that invention transmitting an impact force of about 4,000 metric tonnes has been made and satisfactorily used. In order to transmit such forces, gas pressures of the order of 350 kg/cm$^2$ arise with a striker piston having a diameter of the order of 1.5 meters.

Subsea soil conditions are now being experienced which require even higher impact forces for pile driving. Gas pressures of the order of 350 kg/cm$^2$ are about the maximum which can be used with present seal constructions, and to increase the impact force transmitted by increasing the diameter of the striker piston is not practicable as even the existing diameter involves problems of manipulating and handling the pile driving unit and in fact pile driving units of even lesser diameters would be desirable for certain applications.

The present invention has for its object to provide an apparatus which overcomes these problems. To this end the invention consists in apparatus for driving a pile or similar object by the stroke of a hammer, said apparatus being provided with resilient means in the path of the hammer for transmitting the impact of a stroke to the pile, said resilient means comprising pre-compressed gas in at least two closed chambers (which may intercommunicate) each containing striker means arranged so that, in transmitting the impact force, each striker means moves against the resilience of the gas pressure.

In one embodiment of the invention, each striker means comprises a striker piston, the striker piston being disposed in series and the outermost piston having a striker member depending therefrom which delivers the hammer blow to the pile anvil. The pistons may be separate from or integral with each other. When separate pistons are used, they may normally be in contact but are preferably arranged with a small space therebetween so that the impact force is transmitted in succession in a series of steps or stages through the successive striker pistons. Thus the magnitude of the impact shock wave is divided into successive steps thereby protecting the hammer from disintegration while the pile still experiences the increased impact force.

The two closed chambers may intercommunicate through a small diameter passage so that the gas pressures in each chamber will be substantially equal and can be produced by a common source of pressure such as a floating piston which can be adjusted to create the desired gas pressure under the action of a substantially non-compressible liquid.

Figure 7A:
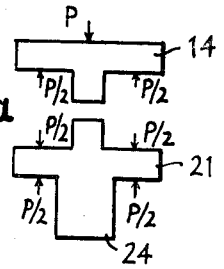
Figure 7B:
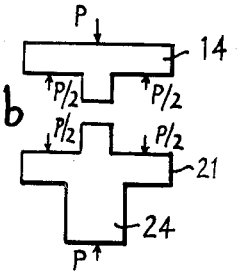
Figure 7C:
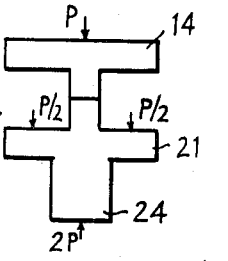
Figure 6:
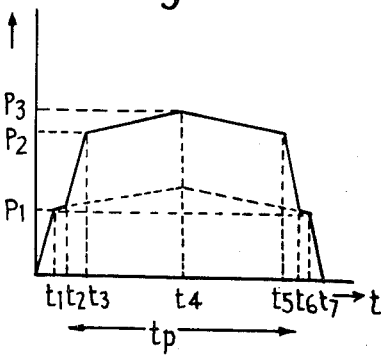
Figure 2:
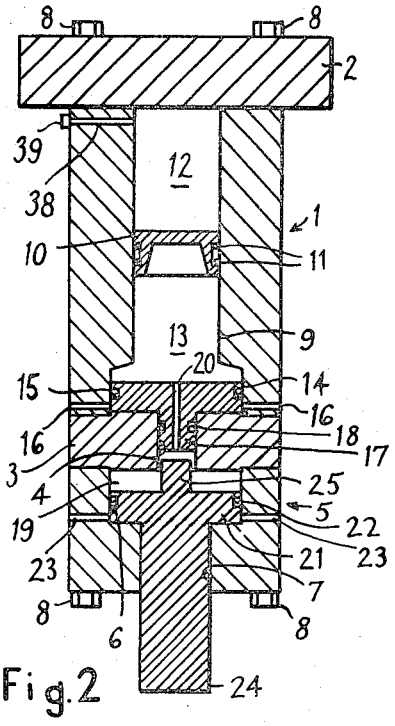
Figure 3:
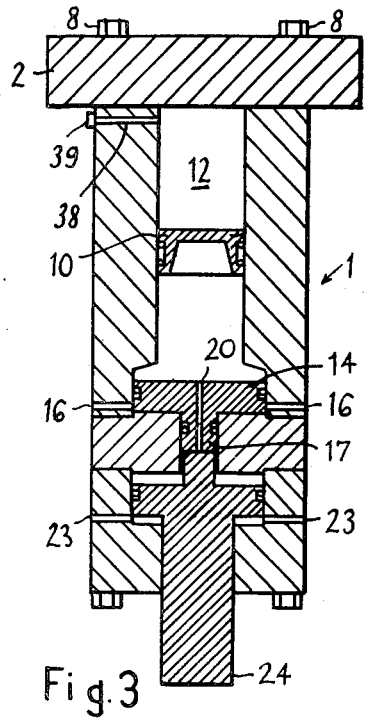
Figure 4:
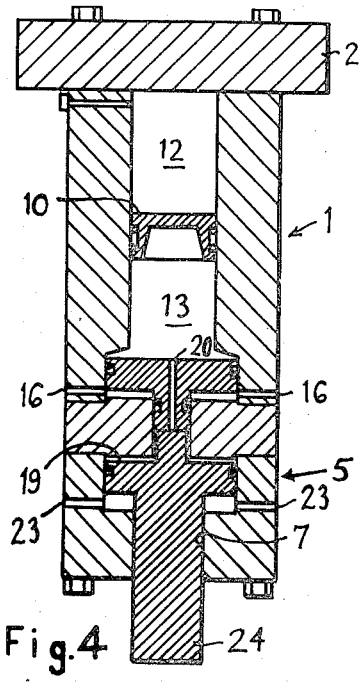
Figure 5:
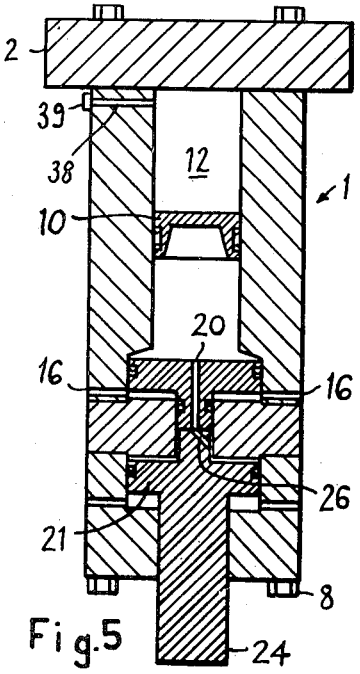

In order that the invention may be more clearly understood, reference will now be made to the accompanying drawings, in which:

FIG. 1 is a part-vertical section through a pile driving apparatus constructed in accordance with one embodiment of the invention, FIG. 2 is a vertical section through the hammer of the apparatus of FIG. 1, the parts being shown in their normal positions before impact, FIG. 3 is a view similar to that of FIG. 2 but showing the position of the parts of the apparatus in a first stage of impact, FIG. 4 is a view similar to that of FIG. 2 but showing the parts of the apparatus in the second stage of impact, FIG. 5 is a view similar to that of FIG. 2 of a modification, FIG. 6 is a time-impact force diagram obtained by using the apparatus according to the invention, and FIGS. 7*a* to 7*c* show the forces exerted on the parts of the apparatus in successive positions during an impact stroke of the hammer.

In the pile driving apparatus shown in FIG. 1 the hammer, comprising a cylinder 1, end plates 2 and 3 and auxiliary cylinder 5 and components incorporated therein as later more fully described, is mounted for vertical movement along the guides 29 above a pile 30. Preferably, as shown, the hammer is mounted in a housing or casing 31 such as is described in U.S. Pat. No. 3,828,866 into which compressed air may be introduced through a connection 32 to remove water from the casing to enable the pile driving apparatus to be operated under sub-aqueous conditions. The casing 31 has a downwardly extending extension or pile sleeve 33 for guiding the apparatus onto and receiving the top of the pile, there being a pile cap or anvil 34 held captive within the sleeve 33 and resting on the top of the pile. The hammer is conveniently lifted and driven downwards to deliver the impact force to the pile by one or more double acting hydraulic piston devices such as 35 which are connected via connections 36 and slack hoses 37 to a source of hydraulic pressure, such as an oil pump, located at a remote station, for example a ship in the case of under water pile driving. Alternatively, the hammer may be lifted by the piston devices and be simply allowed to fall by gravity to deliver the impact force to the pile.

Referring more particularly to FIG. 2 the hammer comprises a cyliinder 1 having a bore 9 which is closed at its upper end by an end plate 2 and at its lower end has an end plate 3 having a central bore 4 therethrough. Beneath the end plate 3 is an auxiliary cylinder 5 having a bore 6 in communication with the bore 4 and also with a central bore 7 through the bottom wall of the auxiliary cylinder 5. The parts 1, 2, 3 and 5 are held rigidly together, conveniently by through-bolts 8 and associated nuts.

Slidably mounted within the bore 9 in the cylinder 1 is a floating piston 10 provided with annular seals 11 and dividing the cylinder bore 9 into two chambers 12 and 13. Inlet means 38 are provided for supplying a subsubstantially non-compressible but readily deformable liquid medium, such as oil, to the chamber 12 from a source of pressurized liquid, for example on the ship, through connections 39, 40 and a slack hose 41. The chamber 13 between the lower surface of the piston 10 and the upper surface of striker piston 14 slidably mounted in an enlarged diameter portion at the lower end of the bore 9 contains a gas which is pre-compressed to the pressure of the liquid medium in the chamber 12 and acts on the piston 10.

The piston 14 is provided with an annular seal 15 to prevent escape of compressed gas from the chamber 13 through vent passages 16 which connect the lower end of the bore 9 to atmosphere, and has a depending projection 17 which extends into the bore 4 and is provided with an annular seal 18.

In the bore 6 of the auxiliary cylinder 5 is a second striker piston 21, the chamber 19 in the bore between the piston 21 and the end plate 3 being in connunication with the chamber 13 via a small diameter passage 20 in the piston 14 so that the chamber 19 also contains gas which is pre-compressed to the same pressure as the gas in chamber 13. Piston 21 is provided with an annular seal 22 to prevent escape of compressed gas from the chamber 19 through vent passages 23 which connect the lower end of bore 6 to atmosphere. Seal 18 on projection 17 serves to prevent escape of compressed gas in chamber 19 to vent passages 16.

The piston 21 has a striker member 24 depending therefrom which strikes the top of the pile anvil or pile cap 34 in operation of the pile driving apparatus. The piston 21 also has an upwardly extending projection 25 of which the free end is spaced a short distance from the free end of the projection 17 when the parts are in their normal positions before impact as shown in FIG. 2.

FIGS. 3 and 4 show the positions assumed by the pistons 14 and 21 during a hammer stroke and serve, inconjunction with the stroke-impact force diagram of FIG. 6, to explain the operation of the apparatus.

Following the initial impact of the striker member 24 upon the top of a pile cap, the impact force rises rapidly to the force $P_1$ at time $t_1$ (FIG. 6) which is determined by the preliminary pressure of the gas in chamber 19, whereafter the striker piston 21 moves against gradually increasing gas pressure in chamber 19 until time $t_2$ when projections 17 and 25 come into contact with each other (see FIG. 3). With continued upward movement of the striker member 24 relative to the hammer, a slight displacement of the striker piston 14 against the pre-compressed gas in chamber 13 produces a rapid rise of the impact force to $P_2$, approximately twice $P_1$, at time $t_3$, whereafter both pistons move against the gas pressure in their respective chambers (see FIG. 4) to a maximum impact force $P_3$ at time $t_4$ and then retract until at time $t_5$ when the piston 14 abuts the end plate 3 the impact force rapidly drops to just above $P_1$. When piston 21 abuts the end wall of the cylinder 5 at time $t_6$, the force again drops rapidly to zero.

It will be apparent from the diagram of FIG. 6 that the magnitude of the impact force increases in two successive steps thereby reducing the shockwave on the pile and the hammer. However, over the time $t_p$ between time $t_3$ and time $t_5$ the pile experiences the full impact force which can be approximately twice the impact force which can be transmitted by a device constructed according to U.S. Pat. No. 3,417,828 with a single striker piston of the same diameter as either of the pistons 14 and 21 and operating under the same precompressed gas pressure. The impact force is not quite doubled by reason of the losses introduced by the diameter of the bore 4 between the two chambers 13 and 19.

If the two pistons are normally in contact or integral as shown in FIG. 5 and do not have a small gap therebetween as shown in the embodiment of FIGS. 1 to 4, the intermediate slow rise in pressure between time $t_1$ and time $t_2$ (FIG. 6) and the similar slow fall between time $t_5$ and $t_6$ would be eliminated, and the rise in pressure to $P_2$ would take place in a single step instead of in two steps as illustrated in the diagram of FIG. 6.

FIGS. *7a* to *7c* illustrate the forces acting on the striker pistons 14, 21 in situations roughly corresponding to those in FIGS. 2 to 4. P represents the force exerted by the precompressed gas and P/2 approximately one half the force P. P/2 is not quite equal to P due to the piston projections 17, 25. FIG. *7a* illustrates the situation as the hammer moves towards the pile; FIG. *7b* illustrates the situation when the hammer strikes the pile and the piston 21 is lifted off the lower end of the bore 6 at which time the force P acts on the striker member 24; and FIG. *7c* illustrates the situation when the piston 14 is lifted off the lower end of the bore 9 by the piston 21 whereby a force 2P exerted by the precompressed gas in both chambers 13 and 19 on the respective pistons 14, 21 acts on the striker member 24. In practice, 2P is not quite double P due to the losses caused by the presence of the piston projection 25.

In the embodiment of FIGS. 1–4, the passage 20 is closed off when the projection 25 abuts the projection 17. However, if desired inter-communication of the chambers 13 and 19 can be maintained at all times by also providing the striker piston 21 with a small passage which communicates with passage 20 when the projections 25 and 17 abut. Such a modification is shown in FIG. 5 where a small passage 26 is provided in the projection 25.

The pressure to which the gas is pre-compressed may be adjusted by displacement of the piston 10 by the oil pressure. A feature of the construction shown consists in making the diameter of the part of the bore 9 in which the piston 10 is movable of smaller diameter than the part of the bore which contains the piston 14. This has the dual advantage of increasing the weight of the hammer and also of strengthening the walls of the cylinder in which the piston 10 moves. The stronger wall better resists deformation and facilitates proper functioning of the seals. This construction of positioning the floating piston 10 in a part of the bore which is of smaller diameter than the part in which the striker piston 14 is located also has advantages in devices incorporating only a single striker piston.

While particular embodiments have been described it will be understood that various embodiments may be made without departing from the scope of the invention. For example, the passage 20 may be omitted so that the chambers 13 and 19 are separated from one another. In this case the gas in the separate chambers must be separately pressurised; they may be pressurised to different pressures. More than two closed chambers and associated striker pistons may be provided in a triple or multiple arrangement. Further, instead of the resilient means and the associated striker pistons being incorporated in the hammer itself they may be incorporated in a separate body arranged in the path of the hammer.

What is claimed is:

1. Apparatus for driving a pile or similar object by the blows of a hammer in which the impact of a hammer blow is transmitted to the pile through resilient means comprising a precompressed gas, said apparatus comprising at least two variable volume compressed gas chambers, each said chamber being closed to the atmosphere and containing a gas which is precompressed to a predetermined value, the chambers being arranged in series in a path by which the impact of a hammer blow is transmitted to the pile whereby the volumes of the respective chambers are decreased by such impact, the predetermined value to which the gas in the chambers is precompressed being such that under the impact of the hammer blow the aggregate of the minimum forces directly available from the respective chambers exceeds the ground resistance.

2. Apparatus as claimed in claim 1 wherein each chamber from the first chamber to the final chamber of the series of chambers is defined by a cylinder and contains a striker piston, the striker pistons being arranged in series, and the piston in the final chamber having a striker member which delivers each hammer blow to the pile, the resulting movement of said striker member being transmitted back through the pistons from the piston in the final chamber to the piston in the first chamber.

3. Apparatus as claimed in claim 2, including means defining a small diameter passage for intercommunicating the chambers, whereby substantially to equalize the gas pressures in the respective chambers.

4. Apparatus as claimed in claim 3, wherein said passage is in at least one of the striker pistons.

5. Apparatus as claimed in claim 3, including a floating piston in the cylinder defining the first chamber and dividing said cylinder into the chamber containing the first striker piston and a pressurizing chamber for receiving a pressurizing liquid, and means for supplying pressurized liquid to said pressurizing chamber.

6. Apparatus as claimed in claim 2, wherein successive striker pistons of the series are arranged with a small space therebetween whereby the resulting movement of the striker member is transmitted through the series of pistons with a delay between successive pistons.

7. Apparatus as claimed in claim 2, wherein the striker pistons are permanently in contact with one another.

8. Apparatus as claimed in claim 1, wherein the closed chambers are in the hammer.

9. Apparatus as claimed in claim 2, wherein the hammer includes a heavy body having side and end walls mounted for movement along guides, hydraulic piston means is connected to move the hammer body, the cylinders comprise means defining plural cylinder bores arranged in series in the hammer body, in which the respective striker pistons are movable, and a central bore interconnecting adjacent cylinder bores and of lesser diameter, means defines an aperture in one end wall of the hammer body and connecting with the final chamber, the striker member projecting through said aperture, the striker pistons being provided with respective sealing means in sealing engagement with the respective cylinder bores, and at least one of adjacent striker pistons having an extension engageable through the interconnecting central bore with the other adjacent piston, means in at least one striker piston defines a passage for intercommunicating adjacent chambers, a floating piston is in the cylinder defining the first chamber and divides said first cylinder into the chamber containing the first striker piston and a pressurizing chamber for receiving a pressurizing liquid, sealing means on said floating piston is in sealing engagement with the bore of said first cylinder, and means are provided for supplying pressurized liquid to said pressurizing chamber.

10. Apparatus as claimed in claim 9, wherein the bore of said first cylinder comprises two sections of larger and smaller diameters, the striker piston in the first chamber being located in the said larger diameter section of the bore and the floating piston being located in the said smaller diameter section of the bore.

* * * * *